US005584592A

United States Patent [19]

Craig

[11] Patent Number: 5,584,592

[45] Date of Patent: Dec. 17, 1996

[54] COMBINATION BALLPOINT PEN AND MECHANICAL PENCIL

[76] Inventor: Elizabeth Craig, 893 Rockaway Ave., Brooklyn, N.Y. 11212

[21] Appl. No.: 441,365

[22] Filed: May 15, 1995

[51] Int. Cl.[6] ..... B43K 21/06; B43K 24/04; B43K 29/02

[52] U.S. Cl. ..... 401/31; 15/424; 401/52

[58] Field of Search ..... 401/31, 52; 15/424

[56] References Cited

U.S. PATENT DOCUMENTS

| | | | |
|---|---|---|---|
| 2,136,290 | 11/1938 | Fend | 401/31 |
| 3,865,496 | 2/1975 | Robbins | 401/31 X |

FOREIGN PATENT DOCUMENTS

| | | | |
|---|---|---|---|
| 855338 | 2/1940 | France | 401/31 |
| 1083636 | 1/1955 | France | 401/31 |
| 1035521 | 7/1958 | Germany | 15/424 |
| 151296 | 6/1991 | Japan | 401/31 |

*Primary Examiner*—Steven A. Bratlie
*Attorney, Agent, or Firm*—Michael I. Kroll

[57] ABSTRACT

A combination ballpoint pen and mechanical pencil comprising a barrel with a nose cone having a hole therethrough. A plurality of different writing cartridges are provided, with each writing cartridge having a writing tip. A component is for radially positioning the writing cartridges within the barrel, so that the writing tips will face the hole in the nose cone of the barrel. Structures are for facilitating manual movement of each writing cartridge with the writing tip to and from the nose cone of the barrel. An element is for guiding one writing tip of one writing cartridge into and out of the hole in the nose cone of the barrel. When the writing tip extends out of the hole, a person can grip the barrel and write with the writing tip.

1 Claim, 1 Drawing Sheet

COMBINATION BALLPOINT PEN AND MECHANICAL PENCIL

BACKGROUND OF THE INVENTION

1. Field of the Invention

The instant invention relates generally to writing instruments and more specifically it relates to a combination ballpoint pen and mechanical pencil.

Ballpoint Pens: The ballpoint pen was invented in Hungary in 1935 by brothers Lazio and George Biro. Instead of a writing point, the ballpoint pen has a tiny metal ball in the tip of a tube filled with ink. Ink sticks to the ball and the ball rolls the ink onto the paper.

The ballpoint pen proved to be valuable to pilots, since it worked at high altitudes and did not have to be refilled frequently. In 1945 the Chicago entrepreneur Milton Reynolds introduced the ballpoint pen in the United States.

The biggest problem in the development of the ballpoint pen was creating ink of the proper consistency. If the ink was too thin, the pen leaked; if the ink was too thick, the pen clogged. Today, ballpoint pens use a heavy, oil-based ink that flows more slowly than the water-based inks generally used in fountain pens.

Mechanical and automatic pencils: In 1822 the mechanical pencil was developed. It is a device that advances the lead so that the pencil never needs sharpening. In some mechanical pencils the lead is inserted in the front end of the pencil, held in place by a slotted cylindrical clamp or an arrangement of jaws, and pushed forward by a rod or cup. A more recent development is the automatic pencil. Up to twenty pieces of lead can be inserted through the eraser end of the pencil and continuously fed to the point. Lead sizes for automatic pencils range from about 0.01 to 0.03 inch (0.03 to 0.08 centimeter).

2. Description of the Prior Art

Numerous writing instruments have been provided in prior art that are adapted to be used for forming letters, words, numbers, drawings, etc. in ink or graphite on various surfaces, such as on paper. While these units may be suitable for the particular purpose to which they address, they would not be as suitable for the purposes of the present invention as heretofore described.

SUMMARY OF THE INVENTION

A primary object of the present invention is to provide a combination ballpoint pen and mechanical pencil that will overcome the shortcomings of the prior art devices.

Another object is to provide a combination ballpoint pen and mechanical pencil being a single writing tool, in which a barrel holds different colored ballpoint pen cartridges and a mechanical pencil cartridge therein, so that any one of the cartridges can be maneuvered into position in the barrel for use.

An additional object is to provide a combination ballpoint pen and mechanical pencil having an eraser, being of the type to be used in conjunction with both the ink cartridges and the pencil cartridge.

A further object is to provide a combination ballpoint pen and mechanical pencil that is simple and easy to use.

A still further object is to provide a combination ballpoint pen and mechanical pencil that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like-reference characters designate the same or similar parts throughout the several views, and wherein.

Similar reference characters denote corresponding features consistently throughout the attached drawings.

DETAILED DESCRIPTION OF THE PREFERRED EMBODIMENTS

Figures 1, 2, 3:
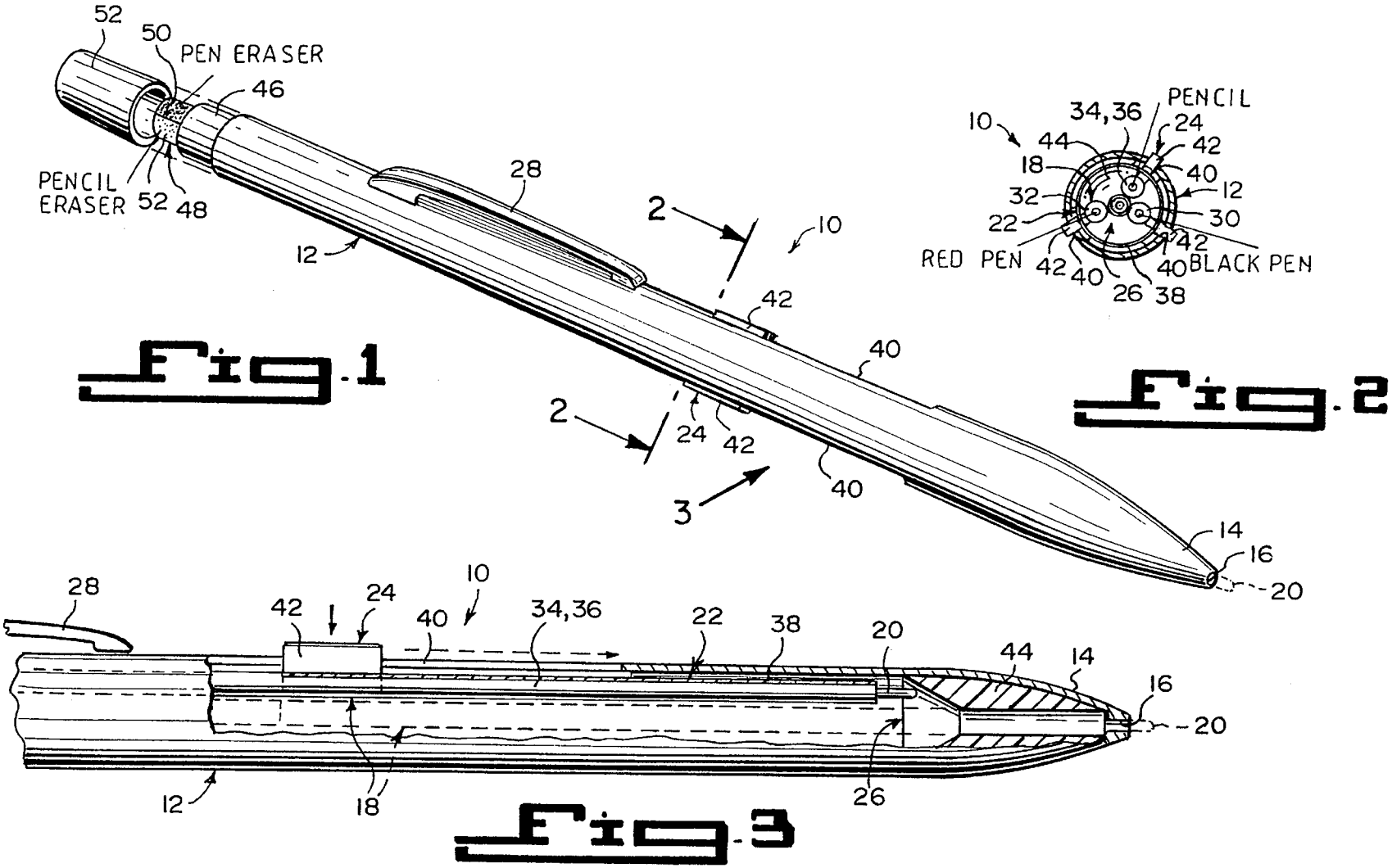
FIG. 1 is a perspective view of the instant invention.
FIG. 2 is a diagrammatic cross sectional view taken generally along line 2—2 in FIG. 1.
FIG. 3 is a side elevational view with parts broken away and in section taken in the direction of arrow 3 in FIG. 1.

Turning now descriptively to the drawings, in which similar reference characters denote similar elements throughout the several views, FIGS. 1 through 3 illustrate a combination ballpoint pen and mechanical pencil 10, comprising a barrel 12 with a nose cone 14 having a hole 16 therethrough. A plurality of different writing cartridges 18, with each writing cartridge 18 having a writing tip 20. A component 22 is for radially positioning the writing cartridges 18 within the barrel 12, so that the writing tips 20 will face the hole 16 in the nose cone 14 of the barrel 12.

Structures 24 are for facilitating manual movement of each writing cartridge 18 with the writing tip 20 to and from the nose cone 14 of the barrel 12. An element 26 is for guiding one writing tip 20 of one writing cartridge 18 into and out of the hole 16 in the nose cone 14 of the barrel 12. When the writing tip 20 extends out of the hole 16, a person can grip the barrel 12 and write with the writing tip 20.

A clip 28 is affixed to the barrel 12, so that the clip 28 can attach the barrel 12 to a garment in a removable manner. The writing cartridges 18 three in number and include a ballpoint pen black ink tube container 30, a ballpoint pen red ink tube container 32 and a mechanical pencil tube container 34. The mechanical pencil tube container 34 contains an automatic lead feed mechanism 36, to continuously supply the respective writing tip 20 with lead.

The radially positioning component 22 is an annular spring 38 carried within the barrel 12, to normally bias the writing cartridges 18 about and away from a central axis of the barrel 12. The manual movement facilitating structure 24 includes the barrel 12 having a plurality of longitudinal slots 40 radially positioned thereabout. A plurality of push buttons 42 are provided. Each push button 42 can slide within one longitudinal slot 40, to advance and retract one respective writing cartridge 18 within the barrel 12. The guiding element 26 is a funnel shaped member 44 affixed into the nose cone 14 of the barrel 12 behind the hole 16. The funnel shaped member 44 will direct each writing tip 20 one at a time into and out of the hole 16.

A ferrule 46 is on an end of the barrel opposite from the nose cone 14. A cylindrical shaped eraser 48 fits into and extends outwardly from the ferrule 46. The eraser 48 is longitudinally divided into an ink portion 50 and a pencil portion 52, to rub out any type of writing made by any of the writing tips 20 on the writing cartridges 18.

The ferrule 46 is integral with the barrel 2 and is of a diameter slightly smaller than the barrel 12. A cap 54 fits over the ferrule 46 and the eraser 48 in a removable manner, so as to protect the eraser 48 when not in use.

OPERATION OF THE INVENTION

To use the combination ballpoint pen and mechanical pencil 10, the following steps should be taken:

1. Grip the barrel 12 by the hand as you would normally do for any other writing tool.
2. Rotate the barrel 12 in your hand until the proper push button 4 is on top, such as for the ballpoint pen black ink tube container 30.
3. Press the push button 42 inwardly.
4. Slide the push button 42 forwardly in the respective longitudinal slot 40 in the barrel 12 until the respective writing tip 20 is guided by the funnel shaped member 42, to extend from the hole 16 in the nose cone 14.
5. For the ballpoint pen red ink tube container 32 follow steps 2 through 4.
6. For the mechanical pencil tube container 34 also follow steps 2 through 4.
7. Remove the cap 54 if an erasure is needed.
8. Use the ink portion 50 of the eraser 46 for mistakes made when using the writing tip 20 of the ballpoint pen black ink tube container 30 or the ballpoint pen red ink tube container 32.
9. Use the pencil portion 52 of the eraser 46 for mistakes made when using the writing tip 20 of the mechanical pencil tube container 34.
10. Replace the cap 54 when the erasure is done.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination ballpoint pen and mechanical pencil comprising:

a) a barrel with a nose cone having a hole therethrough;

b) a plurality of three different writing cartridges including a ballpoint pen black ink tube container, a ballpoint pen red ink tube container, and a mechanical pencil tube container, with each said writing cartridge having a writing tip, said mechanical pencil tube container including automatic lead feed mechanism to continuously supply said respective writing tip with lead;

c) means for radially positioning said writing cartridges within said barrel comprising an annular spring carried within said barrel to normally bias said writing cartridges about and away from a central axis of said barrel, so that said writing tips will face said hole in said nose cone of said barrel;

d) means for facilitating manual movement of each said writing cartridge with said writing tip to and from said nose cone of said barrel comprising a plurality of longitudinal slots radially positioned in said barrel and a plurality of push buttons each slidable within a longitudinal slot to advance and retract one said respective writing cartridge within said barrel;

e) means for guiding one said writing tip of one said writing cartridge into and out of said hole in said nose cone of said barrel comprising a funnel shaped member affixed into said nose cone of said barrel behind said hole to direct each said writing tip one at a time into and out of said hole, so that when said writing tip extends out of said hole, a person can grip said barrel and write with said writing tip;

f) a ferrule on and integral with an end of said barrel opposite from said nose cone and a cylindrical shaped eraser fitted into and extending outwardly from said ferrule, said ferrule being of slightly smaller diameter than said barrel, said eraser being an integral member extending from said ferrule longitudinally divided into an ink portion and a pencil portion to rub out any type of writing made by any of said writing tips on said writing cartridges, and a removable cap fitted on said ferrule to cover and protect said eraser when not in use; and g) clip means affixed to said barrel to removably attach said barrel to a garment.

* * * * *